US005935747A

United States Patent [19]

Miyazaki et al.

[11] Patent Number: 5,935,747

[45] Date of Patent: Aug. 10, 1999

[54] ELECTROPHOTOGRAPHIC PHOTOSENSITIVE MEMBER, AND PROCESS CARTRIDGE AND ELECTROPHOTOGRAPHIC APPARATUS HAVING THE ELECTROPHOTOGRAPHIC PHOTOSENSITIVE MEMBER

[75] Inventors: Hajime Miyazaki, Yokohama; Hideki Anayama, Susono; Hidetoshi Hirano, Shizuoka-ken, all of Japan

[73] Assignee: Canon Kabushiki Kaisha, Tokyo, Japan

[21] Appl. No.: 08/869,507

[22] Filed: Jun. 5, 1997

[30] Foreign Application Priority Data

Jun. 7, 1996 [JP] Japan ..... 8-145999

[51] Int. Cl.[6] ..... G03G 5/47

[52] U.S. Cl. ..... 430/58; 430/66; 399/297

[58] Field of Search ..... 430/58, 59, 96; 399/297, 303

[56] References Cited

U.S. PATENT DOCUMENTS

| | | | |
|---|---|---|---|
| 3,837,851 | 9/1974 | Shattuck et al. | 96/1.5 |
| 3,871,882 | 3/1975 | Wiedemann | 96/1.5 |
| 4,150,987 | 4/1979 | Anderson et al. | 96/1.5 R |
| 4,618,551 | 10/1986 | Stolka et al. | 430/58 |
| 4,772,525 | 9/1988 | Badesha et al. | 430/58 |
| 5,229,481 | 7/1993 | Tilley | 528/10 |
| 5,254,423 | 10/1993 | Mayama et al. | 430/58 |
| 5,278,014 | 1/1994 | Tamaki et al. | 430/58 |
| 5,679,488 | 10/1997 | Itami et al. | 430/58 |

FOREIGN PATENT DOCUMENTS

| | | |
|---|---|---|
| 04036662 | 12/1990 | European Pat. Off. . |
| 51-94828 | 8/1976 | Japan . |
| 51-94829 | 8/1976 | Japan . |
| 61-170749 | 8/1986 | Japan . |
| 62-269964 | 11/1987 | Japan . |
| 3-198061 | 8/1991 | Japan . |

OTHER PUBLICATIONS

Shono, et al.; "Electroreductive Formation of Polysilanes", J. Chem. So., Chem. Commun. No. 17, 1160–61 (1990).

Database WPI, Section Ch, week 9244, Derwent Publ. , Class A26, AN92–361939 of JP4–264130 (XP002043489) (1993).

Database WPI, Section Ch, Week 9326, Derwent Publ., Class A89, AN93–209476, of JP5–134477 (XP002043490) (1993).

*Primary Examiner*—John Goodrow

*Attorney, Agent, or Firm*—Fitzpatrick, Cella, Harper & Scinto

[57] ABSTRACT

An electrophotographic photosensitive member has a support and a photosensitive layer provided on the support. The photosensitive layer containing a polysilane compound which has a structural unit represented by the following Formula (1) and has as a terminal group of the polymer chain a group selected from the group consisting of hydroxy, alkoxy and aryloxy (1)

wherein $R_1$ represents a hydrogen atom, an alkyl group or an aralkyl group; $R_2$ represents an ethyl group, a cycloalkyl group, a vinyl group, or an alkyl group or unsaturated hydrocarbon group having 3 or more carbon atoms, whose carbon atom directly bonded to the phenyl group is a primary carbon atom or a secondary carbon atom.

12 Claims, 1 Drawing Sheet

ELECTROPHOTOGRAPHIC PHOTOSENSITIVE MEMBER, AND PROCESS CARTRIDGE AND ELECTROPHOTOGRAPHIC APPARATUS HAVING THE ELECTROPHOTOGRAPHIC PHOTOSENSITIVE MEMBER

BACKGROUND OF THE INVENTION

1. Field of the Invention

This invention relates to an electrophotographic photosensitive member making use of an organic material. More particularly, this invention relates to an electrophotographic photosensitive member having a photosensitive layer containing a novel polysilane compound capable of imparting an improved electrophotographic performance. The present invention also relates to a process cartridge, and an electrophotographic apparatus, having such an electrophotographic photosensitive member.

2. Related Background Art

Various organic photoconductive polymers including polyvinyl carbazole have been proposed as organic photoconductive materials used in electrophotographic photosensitive members. These polymers are superior to inorganic photoconductive materials in view of film-forming properties, light-weight properties and so forth. Nevertheless, they have not yet attained satisfactory film-forming properties, and are inferior to inorganic photoconductive materials in view of sensitivity, running performance, and stability to environmental changes. As organic photoconductive materials for electrophotographic photosensitive members, hydrazone compounds, triarylpyrazoline compounds and 9-styrylanthracene compounds are proposed as disclosed in U.S. Pat. No. 4,150,987, U.S. Pat. No. 3,837,851, and Japanese Patent Applications Laid-Open No. 51-94828 and No. 51-94829, respectively, which compounds have a low molecular weight. By the use of binders suitably selected, these low-molecular weight organic photoconductive materials have somewhat overcome the disadvantages in film-forming properties which come into question in the field of organic photoconductive polymers, but are not satisfactory in view of sensitivity. In recent years, in order to improve sensitivity to incident light, charge retentivity and surface strength, electrophotographic photosensitive members having a structure wherein the photosensitive layer is functionally separated into a charge generation layer and a charge transport layer are proposed as disclosed in, e.g., U.S. Pat. Nos. 3,837,851 and 3,871,882.

However, as long as the charge transport layer is formed using a conventional low-molecular weight organic photoconductive material, the organic photoconductive material is typically mixed with a certain binder resin when used. Hence, because of the binder resin, the resulting electrophotographic photosensitive member has a low charge mobility, resulting in not always satisfactory sensitivity and performance.

Under such circumstances, polysilane attracts attention as a photoconductive material having a possibility of bringing about the desired electrophotographic photosensitive member.

Examples in which a polysilane is used as a photoconductive material are disclosed in U.S. Pat. Nos. 4,618,551 and 4,772,525 and Japanese Patent Applications Laid-Open No. 62-269964 and No. 3-198061.

According to the disclosure in U.S. Pat. No. 4,618,551, a polysilane compound is applied in an electrophotographic photosensitive member, which is used at a potential as high as 1,000 V, while the surface potential used in usual copying machines is 400 to 800 V by absolute value. This is considered to aim at elimination of spot-like faulty images caused by a structural defect of polysilane. Japanese Patent Application Laid-Open No. 62-269964 also discloses the production of an electrophotographic photosensitive member using a polysilane compound, which has a low photosensitivity, but has no advantage at all when compared with conventional photosensitive members. According to the disclosure in Japanese Patent Application Laid-Open No. 3-198061, a photosensitive member having superior flexibility, film strength and adhesion can be obtained when a polysilane having a substituted or unsubstituted arylene group in its main chain is incorporated in the photosensitive layer. However, the incorporation of carbon atoms in the polysilane main chain sacrifices the high mobility inherent in polysilane.

SUMMARY OF THE INVENTION

On studying the structure of polysilane and electrophotographic performance, it has been discovered that a substituent at the para-position of a phenyl group bonded to polysilane greatly contributes to electrophotographic performance, film-forming properties, mechanical strength of film and image characteristics, and accomplishes the present invention.

A main object of the present invention is to provide an electrophotographic photosensitive member having a photosensitive layer containing an organic photoconductive material, which can fulfill various conditions required in electrophotographic photosensitive members.

Another object of the present invention is to provide an electrophotographic photosensitive member having a photosensitive layer containing a specific polysilane compound, which is superior especially in sensitivity and running performance.

Still another object of the present invention is to provide an electrophotographic photosensitive member having a photosensitive layer containing a specific polysilane compound, which has superior film-forming properties.

A further object of the present invention is to provide an electrophotographic photosensitive member which is superior especially in image characteristics.

A still further object of the present invention is to provide a process cartridge, and an electrophotographic apparatus, having the above electrophotographic photosensitive member.

The present invention is an electrophotographic photosensitive member comprising a support, a photosensitive layer provided on the support; the photosensitive layer containing a polysilane compound which has a structural unit represented by the following Formula (1) and has as a terminal group of the polymer chain a group selected from the group consisting of hydroxy, alkoxy and aryloxy.

(1)

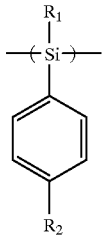

wherein $R_1$ represents a hydrogen atom, an alkyl group or an aralkyl group; $R_2$ represents an ethyl group, a cycloalkyl group, a vinyl group, or an alkyl group or unsaturated hydrocarbon group having 3 or more carbon atoms, whose carbon atom directly bonded to the phenyl group is a primary carbon atom or a secondary carbon atom.

The present invention is also a process cartridge, and an electrophotographic apparatus, having the above electrophotographic photosensitive member.

DESCRIPTION OF THE PREFERRED EMBODIMENTS

Figure 1:
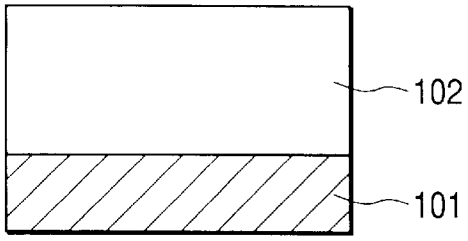
FIG. 1 is a schematic cross-sectional illustration of an electrophotographic photosensitive member according to the present invention, having a photosensitive layer composed of a single layer.

The electrophotographic photosensitive member of the present invention has a photosensitive layer containing a polysilane compound which has a structural unit represented by the following Formula (1)and has as a terminal group of the polymer chain a group selected from the group consisting of hydroxy, alkoxy and aryloxy.

(1)

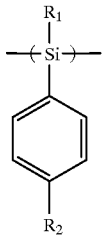

In Formula (1), $R_1$ represents a hydrogen atom, an alkyl group such as a methyl group, an ethyl group, a propyl group or a butyl group, or an aralkyl group such as a benzyl group or a phenethyl group; and $R_2$ represents an ethyl group, a cycloalkyl group, a vinyl group, or an alkyl group or unsaturated hydrocarbon group having 3 or more carbon atoms, whose carbon atom directly bonded to the benzene ring is a primary carbon atom or a secondary carbon atom. The cycloalkyl group may include a cyclopropyl group, a cyclohexyl group and a cyclopentyl group. The alkyl group or unsaturated hydrocarbon group having 3 or more carbon atoms, whose carbon atom directly bonded to the benzene ring is a primary carbon atom or a secondary carbon atom, may include a propyl group, an isopropyl group, a butyl group, an isobutyl group, a s-butyl group, a pentyl group, an isopentyl group, a neopentyl group, an allyl group, a 1-propenyl group and a 2-methylallyl group.

The terminal group of the polymer chain is selected from the group consisting of a hydroxyl group, an alkoxyl group such as a methoxyl group, an ethoxyl group, a propoxyl group or a butoxyl group, or an aryloxyl group such as a phenoxyl group or a naphthyloxyl group.

The alkyl group, aryl group, aralkyl group, cycloalkyl group, vinyl group, unsaturated hydrocarbon group, alkoxyl group and aryloxyl group represented by the foregoing $R_1$, $R_2$ and the terminal group may have a substituent. The substituent is selected from alkyl groups such as a methyl group, an ethyl group, a propyl group and a butyl group, aralkyl groups such as a benzyl group and a phenethyl group, alkoxyl groups such as a methoxyl group, an ethoxyl group, a propoxyl group and a butoxyl group, and silyl groups such as a trimethylsilyl group and a triphenylsilyl group.

In the present invention, in view of the advantages in that a superior electrophotographic performance can be attained and the compound can be synthesized at a low cost, it is preferred that $R_1$ is an alkyl group and $R_2$ is an ethyl group.

In the present invention, the polymer chain may have two or more kinds of the structural unit represented by Formula (1), and besides, structural units other than that unit within the range in which the meritorious effects of the present invention is exhibited.

The polysilane compound of the present invention is preferably the one represented by the following Formula (2).

(2)

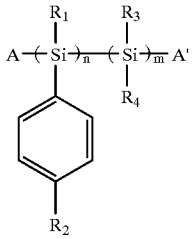

In Formula (2), $R_1$ represents a hydrogen atom, an alkyl group or an aralkyl group; $R_2$ represents an ethyl group, a cycloalkyl group, a vinyl group, or an alkyl group or unsaturated hydrocarbon group having 3 or more carbon atoms, whose carbon atom directly bonded to the phenyl group is a primary carbon atom or a secondary carbon atom; $R_3$ and $R_4$ each represent an alkyl group, an aryl group, an aralkyl group on an alkoxyl group; letter symbols n and m each represent the proportion of monomer units wherein $n \neq 0$ and $m+n=1$; and A and A' each represent a hydroxyl group, an alkoxyl group or an aryloxyl group. In formula (2), $R_1$ and $R_2$ are as defined above, and $R_3$ and $R_4$ each represent an alkyl group such as a methyl group, an ethyl group, a propyl group or a butyl group, an aryl group such as a phenyl group or a naphthyl group, an aralkyl group such as a benzyl group or a phenethyl group, or an alkoxyl group such as a methoxyl group or an ethoxyl group.

Letter symbols n and m represent the proportion of monomer units in the polymer chain, where n is not 0 and the sum of n and m is 1. In the present invention, n may preferably be 0.1 or more. These units may be arranged in the order shown in Formula (1), or the respective units may be arranged alternately or at random. Also, the unit having $R_1$ and $R_2$ and the unit having $R_3$ and $R_4$ may each be arranged in plurality (2 or more).

The alkyl group, aryl group, aralkyl group, cycloalkyl group, vinyl group, unsaturated hydrocarbon group, alkoxyl group and aryloxyl group represented by the foregoing $R_1$ to $R_4$, A and A' may have a substituent. The substituent is selected from alkyl groups such as a methyl group, an ethyl group, a propyl group and a butyl group, aralkyl groups such as a benzyl group and a phenethyl group, alkoxyl groups such as a methoxyl group, an ethoxyl group, a propoxyl group and a butoxyl group, and silyl groups such as a trimethylsilyl group and a triphenylsilyl group.

In the present invention, in view of the advantages in that a superior electrophotographic performance can be attained and also the compound can be synthesized at a low cost, it is preferred that $R_1$ is an alkyl group and $R_2$ is an ethyl group.

Specific examples of the polysilane compound preferably used in the present invention are shown in Tables 1 to 3 below.

TABLE 1

(m is 0)

| Compound No. | $R_1$ | $R_2$ | A | A' | Weight average molecular weight (Mw) |
|---|---|---|---|---|---|
| 1 | H | —$CH_2CH_2CH_3$ | OH | OH | 60,000 |
| 2 | H | —$CH_2(CH_3)_2$ | $OCH_3$ | $OCH_3$ | 80,000 |
| 3 | H | —$CH_2CH_2CH_2CH_3$ | $OCH_3$ | $OCH_3$ | 60,000 |
| 4 | H | —$CH_2CH(CH_3)_2$ | $OC_2H_5$ | $OC_2H_5$ | 35,000 |
| 5 | H | —$CH(CH_3CH_2CH_3$ | OH | OH | 50,000 |
| 6 | H | —$CH(CH_3)CH_2CH_2CH_3$ | $OC_2H_5$ | $OC_2H_5$ | 70,000 |
| 7 | H | —$CH(CH_2CH_3)_2$ | OH | OH | 40,000 |
| 8 | $CH_3$ | —$CH_2CH_2CH_3$ | OH | OH | 47,000 |
| 9 | $CH_3$ | —$CH(CH_3)_2$ | OH | OH | 88,000 |
| 10 | $CH_3$ | —$CH_2CH_2CH_2CH_3$ | OH | OH | 60,000 |
| 11 | $CH_3$ | —$CH_2CH(CH_3)_2$ | OH | OH | 93,000 |
| 12 | $CH_3$ | —$CH(CH_3)CH_2CH_3$ | OH | OH | 49,000 |
| 13 | $CH_3$ | —$CH(CH_3)CH_2CH_2CH_3$ | $OCH_3$ | $OCH_3$ | 30,000 |
| 14 | $CH_3$ | —$CH(CH_3)CH_2CH_2CH_3$ | OH | OH | 30,000 |
| 15 | $CH_3$ | —$CH_2CH_2CH_2CH_3$ | OH | OH | 44,000 |
| 16 | $CH_3$ | 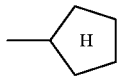 | $OCH_3$ | $OCH_3$ | 20,000 |
| 17 | $CH_3$ | 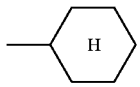 | OH | OH | 30,000 |
| 18 | $CH_3$ | —$CH(CH_2CH_3)_2$ | OH | OH | 70,000 |
| 19 | $C_2H_5$ | —$CH_2CH_2CH_3$ | OH | OH | 110,000 |
| 20 | $C_2H_5$ | —$CH(CH_3)_2$ | OH | OH | 76,000 |
| 21 | $C_2H_5$ | —$CH_2CH_2CH_2CH_3$ | OH | OH | 50,000 |
| 22 | $C_2H_5$ | —$CH(CH_3)CH_2CH_3$ | OH | OH | 33,000 |
| 23 | —$CH_2CH_2CH_3$ | —$CH(CH_3)_2$ | OH | OH | 80,000 |
| 24 | —$CH_2CH_2CH_3$ | —$CH_2CH_2CH_2CH_3$ | OH | OH | 66,000 |
| 25 | —$CH_2CH_2CH_2CH_3$ | —$CH(CH_3)CH_2CH_3$ | $OCH_3$ | $OCH_3$ | 45,000 |
| 26 | —$CH_2CH_2CH_2CH_3$ | —$CH(CH_3)CH_2CH_2CH_3$ | OH | OH | 50,000 |
| 27 | $PhCH_2$— | —$CH(CH_3)_2$ | OH | OH | 25,000 |
| 28 | —$C(CH_3)_3$ | —$CH(CH_3)_2$ | $OCH_3$ | $OCH_3$ | 30,000 |
| 29 | $PhCH_2CH_2$— | —$CH(CH_3)_2$ | OPh | OPh | 20,000 |
| 30 | $CH_3$ | —$C_2H_5$ | OH | OH | 96,000 |
| 31 | $CH_3$ | —CH=$CH_2$ | OH | OH | 60,000 |
| 32 | $CH_3$ | —$CH_2CH$=$CH_2$ | OH | OH | 55,000 |
| 33 | $CH_3$ | —$CH_2C(CH_3)$=$CH_2$ | OH | OH | 78,000 |
| 34 | $C_2H_5$ | —$C_2H_5$ | OH | OH | 88,000 |

TABLE 2

(m is not O)

| Compound No. | $R_1$ | $R_2$ | $R_3$ | $R_4$ | n | A | A' | Weight average molecular weight (Mw) |
|---|---|---|---|---|---|---|---|---|
| 35 | $CH_3$ | $C_2H_5$ | $CH_2$ | $CH_3$ | 0.5 | OH | OH | 200,000 |
| 36 | $CH_3$ | $C_2H_5$ | $CH_3$ | Ph | 0.1 | OH | OH | 150,000 |
| 37 | $CH_3$ | $C_2H_5$ | Ph | Ph | 0.5 | OH | OH | 70,000 |
| 38 | $CH_3$ | $C_2H_5$ | $C_2H_5$ | $CH_3$ | 0.5 | OH | OH | 40,000 |
| 39 | $CH_3$ | $—CH_2CH_2CH_3$ | $CH_3$ | —PhOMe(m) | 0.5 | OH | OH | 80,000 |
| 40 | $CH_3$ | $—CH_2CH_2CH_3$ | $—CH_2CH_2CH_2CH_3$ | $—CH_2CH_2CH_2CH_3$ | 0.5 | OH | OH | 79,000 |
| 41 | $CH_3$ | $—CH_2CH_2CH_2CH_3$ | $CH_3$ | $—CH_2Ph$ | 0.5 | OH | OH | 90,000 |
| 42 | $CH_3$ | $C_2H_5$ | $CH_3$ | $—CH_2CH_2Ph$ | 0.5 | OH | OH | 110,000 |
| 43 | $CH_3$ | $—CH_2CH{=}CH_2$ | $—OCH_3$ | $—OCH_3$ | 0.5 | OH | OH | 130,000 |
| 44 | $CH_3$ | $C_2H_5$ | $CH_3$ | $—PhCH_2CH_2CH_3$(p) | 0.5 | OH | OH | 97,000 |
| 45 | $CH_3$ | $—CH_2CH_2CH_2CH_3$ | $CH_3$ | $—PhCH(CH_3)_2$(p) | 0.5 | OH | OH | 50,000 |
| 46 | $CH_3$ | $C_2H_5$ | $CH_3$ | $—PhCH_2CH_2CH_2CH_3$(p) | 0.5 | OH | OH | 100,000 |
| 47 | $CH_3$ | $C_2H_5$ | $CH_3$ | $—PhCH_2CH_2CH_2CH_3$(p) | 0.7 | OH | OH | 150,000 |
| 48 | $CH_3$ | $C_2H_5$ | $CH_3$ | $—PhCH_2CH_2CH_2CH_3$(p) | 0.9 | OH | OH | 100,000 |
| 49 | $CH_3$ | $C_2H_5$ | $CH_3$ | $—PhCH_2CH_2CH_2CH_3$(p) | 0.3 | OH | OH | 90,000 |
| 50 | $CH_3$ | $C_2H_5$ | $CH_3$ | $—PhCH_2CH_2CH_3$(p) | 0.3 | OH | OH | 90,000 |
| 51 | $CH_3$ | $—CH_2CH_2CH_3$ | $CH_3$ | $—PhCH(CH_3)CH_2CH_2$(p) | 0.5 | OH | OH | 80,000 |
| 52 | $CH_3$ | $—CH_2CH_2CH_3$ | $CH_3$ | $—PhCH(CH_3)_2$(p) | 0.5 | OH | OH | 70,000 |
| 53 | $CH_3$ | $C_2H_5$ | $CH_3$ | $—PhCH_2CH_2CH_3$(p) | 0.5 | $OCH_3$ | OH | 100,000 |

TABLE 3

| Compound No. | $R_1$ | $R_2$ | Molar ratio | $R_3$ | $R_4$ | Molar ratio | n | A | A' | Weight average molecular weight (Mw) |
|---|---|---|---|---|---|---|---|---|---|---|
| 54 | $—CH_3$ | $C_2H_5$ | 50 | — | — | — | 1 | OH | OH | 100,000 |
| | $—CH_3$ | $CH_2CH_2CH_3$ | 50 | | | | | | | |
| 55 | $—CH_3$ | $C_2H_5$ | 60 | — | — | — | 1 | OH | OH | 80,000 |
| | $—CH_3$ | $—CH_2CH_2CH_2CH_3$ | 40 | | | | | | | |
| 56 | $—CH_3$ | $—C_2H_5$ | 70 | $—CH_3$ | —Ph | 100 | 0.5 | OH | OH | 150,000 |
| | $—CH_3$ | $—CH(CH_3)_2$ | 30 | | | | | | | |
| 57 | $—CH_3$ | $—C_2H_5$ | 80 | $—CH_3$ | —Ph | 90 | 0.8 | OH | OH | 170,000 |
| | $—CH_3$ | $—CH_2CH_2CH_3$ | 20 | $—CH_3$ | $—CH_2Ph$ | 10 | | | | |
| 58 | $—CH_3$ | $—C_2H_5$ | 100 | $—CH_3$ | —Ph | 50 | 0.7 | OH | OH | 190,000 |
| | | | | $—C_2H_5$ | —Ph | 50 | | | | |

PRODUCTION EXAMPLE

The polysilane compound described above can be produced by using a known production process (the Wurtz process or the electrolytic reduction process).

Production by the Wurtz process is cited in Japanese Patent Application Laid-Open No. 61-170749. The compound can be obtained by adding a solvent toluene to a starting material dichlorosilane of various types to carry out dechlorination condensation reaction at 95 to 120° C. in the presence of sodium. As an example of the production by the electrolytic reduction process, there is a process disclosed in Journal of Chemical Society, Chemical Communication, 1160 (1990). More specifically, the compound can be obtained by adding a tetrahydrofuran solvent to a starting dichlorosilane material of various types to carry out reduction on an Mg electrode using lithium perchlorate as a support electrolyte.

The polysilane compound of the present invention, produced by the above production process can have a molecular weight of from 6,000 to 2,000,000 as weight average molecular weight (Mw), which depends on production conditions.

The electrophotographic photosensitive member of the present invention is basically constituted of a support on which a photosensitive layer containing the polysilane compound described above is provided.

The photosensitive layer may be constituted of a single layer, or may be constituted of a plurality of layers functionally separated. In the present invention, the photosensitive layer may preferably be constituted of a plurality of layers functionally separated.

FIG. 1 diagrammatically illustrates an example of the electrophotographic photosensitive member according to the present invention, having a single layer photosensitive layer. In FIG. 1, reference numeral 101 denotes the support; and 102, the photosensitive layer containing the polysilane compound described above. In this instance, the photosensitive layer 102 is a photosensitive layer containing the polysilane compound described above, i.e., a material having the ability to transport electric charges (charge-transporting material), and a material having the ability to generate electric charges (charge-generating material). The electrophotographic photosensitive member shown in FIG. 1 may optionally have, between the support and the photosensitive layer, a subbing layer (not shown) having the function as a barrier and the function of adhesion, and may also have, on the photosensitive layer, a surface protective layer (not shown) for protecting the photosensitive layer.

In the photosensitive layer shown in FIG. 1, the charge-generating material and the charge-transporting material (the polysilane compound described above) may be contained in a weight ratio (charge-generating material:charge-transporting material) of from 1:100 to 1:1, and particularly preferably from 1:20 to 1:3, and may preferably be contained in such a state that both the materials are uniformly dispersed in that layer. The layer may preferably have a thickness of from 4 to 40 μm, and particularly preferably from 7 to 30 μm.

As the charge-generating material, any of known organic charge-generating materials or known inorganic charge-generating materials may be selectively used. Such organic charge-generating materials may include, e.g., azo pigments, phthalocyanine pigments, anthanthrone pigments, quinone pigments, pyrazolone pigments, indigo pigments, quinacridone pigments, and pyrylium pigments. The inorganic charge-generating materials may include, e.g., selenium, selenium-tellurium, and selenium-arsenic.

The photosensitive layer shown in FIG. 1 can be formed, e.g., in the following way: First, a predetermined amount of the charge-generating material described above is dispersed in a suitable solvent. In the dispersion thus obtained, a predetermined amount of the polysilane compound is dissolved to prepare a coating fluid. The coating fluid obtained is applied on the surface of the support by an appropriate coating means so that the coating layer may have a thickness within the above range after drying, and the wet coating thus formed is dried to harden by a known means. The solvent usable here may include aromatic solvents such as benzene, toluene and xylene, halogen type solvents such as dichloromethane, dichloroethane and chloroform, in addition to tetrahydrofuran and dioxane.

As the coating means, it may include wire bar coating, dipping, doctor blade coating, spraying, roll coating, bead coating and spin coating.

In the case when the subbing layer described above is provided in the electrophotographic photosensitive member, it may preferably be formed with a layer thickness of from 0.1 to 5 μm, and particularly preferably from 0.1 to 3 μm.

The subbing layer may be formed of an appropriate material selected from the group consisting of casein, polyvinyl alcohol, nitrocellulose, polyamides such as nylon 6, nylon 66, nylon 610, copolymer nylon and alkoxymethylated nylon, polyurethanes, and aluminum oxide. The subbing layer can be formed in the following way: In the case when the material for the subbing layer is soluble in solvents, it is dissolved in a suitable solvent, and when the material is insoluble in solvents, it is dispersed in a binder resin solution. The coating fluid thus obtained is applied on the surface of the support 101 by the same method as the case of the photosensitive layer described above, and the wet coating thus formed is dried to harden.

In the case when the surface protective layer described above is provided on the electrophotographic photosensitive member, it may preferably be formed in a layer thickness ranging from 0.1 to 5 μm. The surface protective layer may be made of a resin including polycarbonate A, polycarbonate Z, polyarylates, polyesters and polymethyl acrylate. The surface protective layer may contain additives such as a resistance modifier and a deterioration preventive agent.

The surface protective layer can be formed in the following way: The above resin is dissolved in a suitable solvent, and the coating fluid thus obtained is applied on the surface of the photosensitive layer previously formed, by the same method as the case of the photosensitive layer described above, and the wet coating thus formed is dried to harden.

In the case when a resistance modifier, a deterioration preventive agent, etc. are incorporated in the surface protective layer, these additives may be dispersed in the coating fluid for the surface protective layer.

Figure 2:
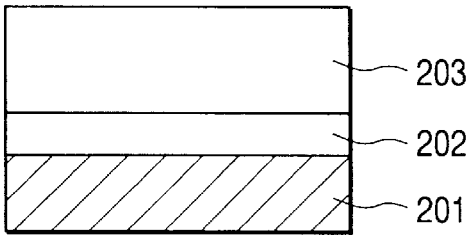
FIG. 2 is a schematic cross-sectional illustration of an electrophotographic photosensitive member according to the present invention, having a photosensitive layer composed of a plurality of layers.
Figure 3:
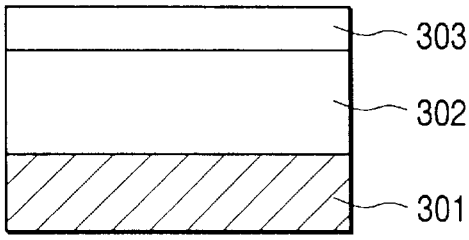
FIG. 3 is a schematic cross-sectional illustration of an electrophotographic photosensitive member according to the present invention, having a photosensitive layer composed of-a plurality of layers.

FIGS. 2 and 3 diagrammatically illustrate examples of the electrophotographic photosensitive member having a photosensitive layer constituted of a plurality of layers functionally separated. More specifically, the electrophotographic photosensitive member shown in FIG. 2 comprises a support 201, and a charge generation layer 202 containing the charge-generating material and a charge transport layer 203 containing the polysilane compound described above which are formed in this order on the support 201 side. The electrophotographic photosensitive member shown in FIG. 3 comprises a support 301, on which a charge transport layer 302 containing the polysilane compound described above and a charge generation layer 303 containing the charge-generating material which are formed in this order.

As in the case of the FIG. 1 electrophotographic photosensitive member, the electrophotographic photosensitive members shown in FIGS. 2 and 3 may also optionally have a subbing layer (not shown) and a surface protective layer (not shown).

More specifically, with regard to the subbing layer, it is provided between the support 201 and the charge generation layer 202 in the case of the FIG. 2 electrophotographic photosensitive member, and is provided between the support 301 and the charge transport layer 302 in the case of the FIG. 3 electrophotographic photosensitive member.

With regard to the surface protective layer, it is provided on the charge transport layer 203 in the case of the FIG. 2 electrophotographic photosensitive member, and is provided on the charge generation layer 303 in the case of the FIG. 3 electrophotographic photosensitive member.

The charge generation layer 202 shown in FIG. 2 may preferably have a layer thickness of from 0.01 to 5 μm, and particularly preferably from 0.05 to 2 μm. The charge transport layer 203 may preferably have a layer thickness of from 4 to 50 μm, and particularly preferably from 7 to 30 μm.

The charge transport layer 302 shown in FIG. 3 may preferably have a layer thickness of from 4 to 50 μm, and particularly preferably from 7 to 30 μm. The charge generation layer 303 may preferably have a layer thickness of from 1 to 15 μm, and particularly preferably from 3 to 10 μm.

In the case when a subbing layer is provided in the electrophotographic photosensitive member shown in FIG. 2 or 3, it may preferably be formed in a layer thickness of from 0.1 to 5 μm, and particularly preferably from 0.1 to 3 μm. Similarly, in the case when the surface protective layer is provided, it may preferably be formed in a layer thickness of from 0.1 to 5 μm.

As the charge-generating material contained in the charge generation layer 202 or 303, any of known organic charge-generating materials or known inorganic charge-generating materials may be selectively used. As examples of such organic charge-generating materials, they may include azo pigments, phthalocyanine pigments, anthanthrone pigments, quinone pigments, pyranthrone pigments, indigo pigments, quinacridone pigments, and pyrylium pigments. Similarly, as examples of the inorganic charge-generating materials, they may include selenium, selenium-tellurium, and selenium-arsenic.

The charge generation layer 202 or 303 can be formed by a method in which the charge-generating material is vacuum-deposited by a known means or a method in which a coating fluid containing the charge-generating material is prepared and applied, followed by drying to harden. Of these two methods, the latter method is preferred. That is, the latter method enables easy control of the state of dispersion of the charge-generating material in the formal charge generation layer. Stated specifically, the charge-generating material is introduced together with a suitable dispersion medium into a suitable solvent to prepare a coating fluid having the charge-generating material uniformly dispersed therein. This coating fluid is applied to form a wet coating, and the wet coating is dried to harden to form the charge generation layer.

As preferred examples of the dispersion medium, it may include so-called binder resins such as insulating resins and organic photoconductive polymers. As specific examples of such binder resins, they may include polyvinyl butyral, polyvinyl benzal, polyarylates, polycarbonates, polyesters, phenoxy resins, cellulose resins, acrylic resins and polyurethanes. Besides these, the above-mentioned polysilane compound to be used in the present invention may also be used as the dispersion medium. In either case, the dispersion medium may preferably be used in an amount not more than 80% by weight, and more preferably not more than 40% by weight, as a content (weight ratio) in the finished charge generation layer (202 or 303).

The solvent may be any of solvents capable of dissolving the binder resin so that the charge-generating material is uniformly dispersed in the binder resin dissolved therein. As examples of such solvents, they may include, e.g., ethers such as tetrahydrofuran and 1,4-dioxane; ketones such as cyclohexanone and methyl ethyl ketone; amides such as N,N-dimethylformamide; esters such as methyl acetate and ethyl acetate; aromatics such as toluene, xylene and chlorobenzene; alcohols such as methanol, ethanol and 2-propanol; and aliphatic halogenated hydrocarbons such as chloroform, methylene chloride, dichloroethylene, carbon tetrachloride and trichloroethylene.

As methods for coating the coating fluid to form a wet coating, known appropriate coating processes can be employed. Such coating processes may include wire bar coating, dipping, doctor blade coating, spraying, roll coating, bead coating and spin coating.

To dry and harden the wet coating thus formed, any known air-drying processes may be employed, e.g., a drying/hardening process that does not damage the charge generation layer (202 or 303).

The charge transport layer containing the polysilane compound described above can be formed by the same method as the case when the above charge generation layer (202 or 303) is formed. More specifically, the charge transport layer can be formed in the following way: The polysilane compound is dissolved in a solvent preferably in an amount of from 5 to 40% by weight, and more preferably from 10 to 30% by weight, based on the weight of the solvent to prepare a coating fluid, which is applied to formed a wet coating, and the wet coating is dried to harden.

As the above solvent, it may include aromatic solvents such as benzene, toluene and xylene, halogen type solvents such as dichloromethane, dichloroethane and chloroform, and tetrahydrofuran and dioxane.

The coating fluid may be applied and the wet coating may be dried to harden in the same way as in the formation of the charge generation layer (202 or 303).

In the case when the subbing layer and/or the surface protective layer is/are formed, these layers both can be formed by the same method as in the case of the FIG. 1 electrophotographic photosensitive member.

The support (101, 201, 301) of the electrophotographic photosensitive member of the present invention may be any of those having a conductivity it may have any desired form of cylindrical, beltlike and platelike. As for its material, the whole may be formed of a conductive member. Alternatively, its base may be made of an insulating material and its side on which the photosensitive layer is provided is subjected to conductive treatment. As examples of the former case, the support may include members of metals such as copper and zinc and alloys such as aluminum alloy and stainless steel. As for the latter case, the support may include a member comprising a plastic base member made of polyethylene, polypropylene, polyvinyl chloride, polyethylene terephthalate or acrylic resin on the surface of which a film of the above metal has been formed by vacuum deposition; a member comprising the above plastic base member but on the surface of which conductive particles of titanium oxide, tin oxide, carbon black or silver are applied using a suitable binder; and a member comprising a base member such as paper or plastic impregnated with the above conductive particles. Besides these members, a member comprising a suitable metal base member on the surface of which the above conductive particles are applied using a suitable binder may also be used as the support.

In all the cases of the electrophotographic photosensitive members shown in FIGS. 1 to 3, when a next layer is formed on a layer previously formed, it is preferable to select and use a solvent that does not dissolve the layer previously formed.

In the present invention, the charge transport layer 203 or 302 containing the polysilane compound described above may also simultaneously contain a known charge-transporting material. More specifically, any known charge-transporting material including pyrazoline compounds, hydrazone compounds, polyvinyl carbazole compounds, styryl compounds and triarylamine compounds may be mixed with the polysilane compound in any desired proportion to form the charge transport layer.

Figure 4:
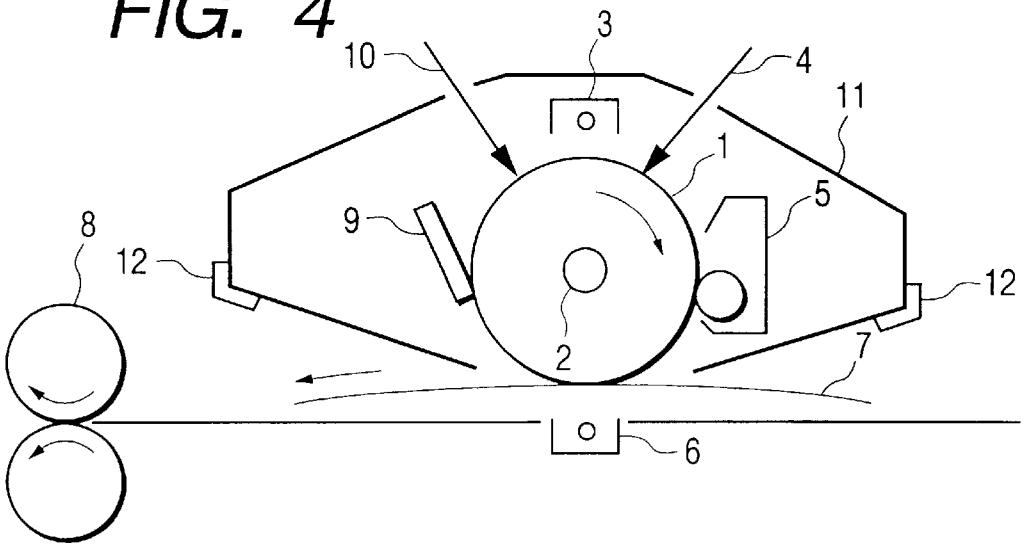
FIG. 4 schematically illustrates an example of the construction of an electrophotographic apparatus having a process cartridge having the electrophotographic photosensitive member of the present invention.

FIG. 4 schematically illustrates the construction of an electrophotographic apparatus having a process cartridge having the electrophotographic photosensitive member of the present invention.

In FIG. 4, reference numeral 1 denotes a drum type electrophotographic photosensitive member, which is rotatingly driven around an axis 2 in the direction of an arrow at a given peripheral speed. The photosensitive member 1 is uniformly electrostatically charged on its periphery to a positive or negative, given potential through a primary charging means 3. The photosensitive member thus charged is then exposed to image-wise light 4 emitted from an image exposure means (not shown) such as a slit exposure or a laser beam scanning exposure. In this way, electrostatic latent images are successively formed on the periphery of the photosensitive member 1.

The electrostatic latent images thus formed are subsequently developed with toner by the operation of a developing means 5. The resulting toner-developed images are then successively transferred by the operation of a transfer means 6, to the surface of a transfer medium 7 fed from a paper feed section (not shown) to the part between the photosensitive member 1 and the transfer means 6 in the manner synchronized with the rotation of the photosensitive member 1.

The transfer medium 7 on which the images have been transferred is separated from the surface of the photosensitive member, and led through an image fixing means 8, where the images are fixed, and is then put out of the apparatus as a copied material (a copy).

The surface of the photosensitive member 1 after the transfer of images is brought to removal of the toner remaining after the transfer, through a cleaning means 9. Thus the photosensitive member is cleaned on its surface, further subjected to charge elimination by pre-exposure light 10 emitted from a pre-exposure means (not shown), and then repeatedly used for the formation of images. When the primary charging means is a contact charging means making use of a charging roller or the like, the pre-exposure is not necessarily required.

In the present invention, the apparatus may be constituted of a combination of plural components integrally joined as a process cartridge from among the constituents such as the above electrophotographic photosensitive member 1, primary charging means 3, developing means 5 and cleaning means 9 so that the process cartridge is detachable from the body of the electrophotographic apparatus such as a copying machine or a laser beam printer. For example, at least one of the primary charging means 3, the developing means 5 and the cleaning means 9 may be integrally supported in a cartridge together with the electrophotographic photosensitive member 1 to form a process cartridge 11 that is detachable from the body of the apparatus through a guide means such as a rail 12 provided in the body of the apparatus.

In the case when the electrophotographic apparatus is used as a copying machine or a printer, the light 4 of the imagewise exposure is light reflected from, or transmitted through, an original, or light irradiated by the scanning of a laser beam, the driving of an LED array or the driving of a liquid crystal shutter array according to signals obtained by reading an original and converting the information into signals.

The electrophotographic photosensitive member of the present invention as described above can be not only applied in electrophotographic copying machines of various types, but also applied as output means of laser beam printers, CRT printers, LED printers, liquid-crystal printers, laser beam engravers and facsimile machines.

The present invention will be described below in greater detail by giving Examples. The present invention is by no means limited by these Examples.

[EXAMPLE 1]

An electrophotographic photosensitive member of the type as shown in FIG. 2 was produced.

An aluminum substrate of 10 cm×10 cm in size and 50 $\mu$m thick was used as the support 201.

First, the charge generation layer 202 was formed on the surface of the aluminum support in the following way: 10 parts by weight of oxytitanium phthalocyanine and 5 parts by weight of polyvinyl butyral were dispersed in 90 parts by weight of methyl ethyl ketone by means of a ball mill to prepare a coating fluid for the charge generation layer 202. The coating fluid thus obtained was applied on the surface of the aluminum substrate by wire bar coating in an amount to provide a layer thickness of 0.3 $\mu$m after drying, to form a wet coating, which was then dried to form the charge generation layer 202 in a thickness of 0.3 $\mu$m.

Next, 25 parts by weight of a polysilane compound, compound No. 8, was dissolved in 75 parts by weight of toluene to prepare a coating fluid for the charge transport layer 203. The coating fluid thus obtained was applied on the surface of the charge generation layer 202 previously formed, by wire bar coating in a coating amount providing a layer thickness of 20 $\mu$m after drying, to form a wet coating, which was then dried to form the charge transport layer 203 in a thickness of 20 $\mu$m.

The electrophotographic photosensitive member (Sample No. 1) thus obtained was evaluated from various viewpoints. First, the state of coating film of the electrophotographic photosensitive member obtained was visually observed.

Next, the electrophotographic photosensitive member (Sample No. 1) was corona-charged at −5 kV in a static system by the use of an electrostatic copying paper test apparatus Model SP-428, manufactured by Kawaguchi Denki K.K. After kept for 1 second in the dark, the charged sample was exposed to light at an illuminance of 2.5 lux to examine photosensitivity, and thereafter subjected to intense exposure (illuminance: 20 lux/sec.) to make charge elimination.

To examine charge characteristics, the amount of exposure necessary for attenuating to ½ the potential of 1 second after the corona charging ($V_1$), E½, was measured.

Residual potential $V_{SL}$ after the intense exposure was also measured. The initial residual potential was regarded as $V^0_{SL}$.

The electrophotographic photosensitive member was fastened to a cylinder for a photosensitive member of a laser beam printer LBP-450, manufactured by CANON INC., and this was set in the laser beam printer to print images. Initial images formed were visually evaluated. Subsequently, images were continuously printed on 3,000 sheets, and the images formed after 3,000 sheet printing were visually evaluated.

After the 3,000 sheet printing, the electrophotographic photosensitive member was taken out of the laser beam printer, and was set in the electrostatic copying paper test apparatus Model SP-428 to further examine the charge characteristics, where the variation of residual potential ($V_{SL}$), $\Delta V_{SL}$, was measured.

Results obtained are shown in Table 4.

[Examples 2 to 52]

Electrophotographic photosensitive members (Sample Nos. 2 to 52) were produced in the same manner as in Example 1 except that the polysilane compound No. 8 was replaced with the polysilane compounds shown in Table 4, respectively.

The electrophotographic photosensitive members obtained were each evaluated in the same manner as in Example 1.

Results obtained are shown in Table 4.

[Comparative Example 1]

An electrophotographic photosensitive member (Sample No. E-1) was produced in the same manner as in Example 1 except that the polysilane compound No. 8 was replaced with the following polysilane compound (D-1) (a is an integer; Mw: 100,000).

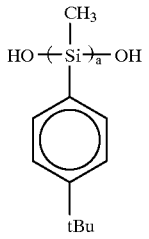

The electrophotographic photosensitive member thus obtained was evaluated in the same manner as in Example 1.

Results obtained are shown in Table 4.

[Comparative Example 2]

The procedure up to the formation of the charge generation layer 202 in Example 1 was repeated Subsequently, 25 parts by weight of the following polysilane compound (D-2) (b is an integer; Mw: 80,000).

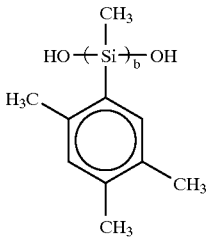

was dissolved in 75 parts by weight of toluene to prepare a coating fluid for the charge transport layer 203. The coating fluid was applied on the surface of the charge generation layer 202 previously formed, in a coating weight providing a layer thickness of 20 $\mu$m after drying, to form a wet coating, which was then dried to form the charge transport layer 203 but having an orange peel surface undesirably.

The electrophotographic photosensitive member (Sample No. E-2) thus obtained was evaluated in the same manner as in Example 1.

Results obtained are shown in Table 4.

[Comparative Examples 3 and 4]

Two electrophotographic photosensitive members (Sample Nos. E-3 and E-4) were produced in the same manner as in Example 1 except that the polysilane compound No. 8 was replaced with the following polysilane compounds (D-3 and D-4) (c and d are each an integer; Mw: 150,000 and 100,000), respectively.

(D-3)

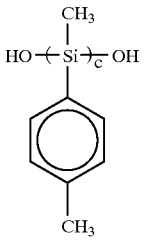

(D-4)

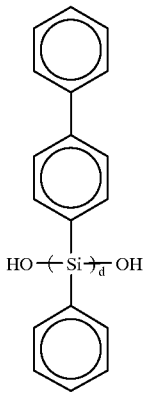

The electrophotographic photosensitive members thus obtained were evaluated in the same manner as in Example 1.

Results obtained are shown in Table 4.

[Examples 53 to 56]

Electrophotographic photosensitive members of the type as shown in FIG. 3 were produced.

An aluminum substrate of 10 cm×10 cm in size and 50 $\mu$m thick was used as the support 301.

First, the charge transport layer 302 was formed on the surface of the aluminum support in the following way: 25 parts by weight of a polysilane compound, compound No. 35, 36, 46 and 52, respectively, was dissolved in 75 parts by weight of toluene to prepare a coating fluid for the charge transport layer 302. The coating fluid thus obtained was applied on the surface of the aluminum substrate, by wire bar coating in a coating weight providing a layer thickness of 20 $\mu$m after drying, to form a wet coating, which was then dried to form the charge transport layer 302 in a thickness of 20 $\mu$m.

Next, 5 parts by weight of chloroaluminum phthalocyanine and 25 parts by weight of polycarbonate resin were dispersed in 70 parts by weight of toluene by means of a ball mill to prepare a coating fluid for the charge generation layer 303. The coating fluid thus obtained was applied on the surface of the charge transport layer 302 previously formed, by wire bar coating in a coating weight providing a layer thickness of 3 $\mu$m after drying, to form a wet coating, which was then dried to form the charge generation layer 303 with a thickness of 3 $\mu$m.

The electrophotographic photosensitive members (Sample Nos. 53 to 56) thus obtained were evaluated in the same manner as in Example 1, except that the polarity of primary charging was turned positive.

Results obtained are shown in Table 4.

[Comparative Examples 5 to 8]

Electrophotographic photosensitive members (Sample Nos. E-5 to E-8) were produced in the same manner as in Example 53 except that the polysilane compound No. 35 was replaced with the polysilane compounds (Nos. D-1 to D-4) used in Comparative Examples 1 to 4, respectively.

The electrophotographic photosensitive members thus obtained were evaluated in the same manner as in Example 53.

Results obtained are shown in Table 4.

[Comparative Example 9]

An electrophotographic photosensitive member (Sample No. E-9) was produced in the same manner as in Example 53 except that the polysilane compound No. 35 was replaced with the following polysilane compound (D-5) (e is an integer; Mw: 50,000).

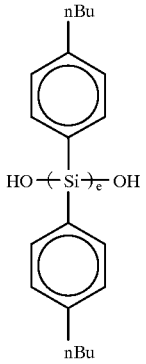

The electrophotographic photosensitive member thus obtained was evaluated in the same manner as in Example 53.

Results obtained are shown in Table 4.

[ Examples 57 to 65]

Electrophotographic photosensitive members of the type as shown in FIG. 1 were produced.

An aluminum substrate of 10 cm×10 cm in size and 50 $\mu$m thick was used as the support 101.

The photosensitive layer 102 was formed in the following way: 5 parts by weight of X-type metal-free phthalocyanine and 20 parts by weight of a polysilane compound, compound No. 30, 48, 49 and 53 to 58, respectively, was dissolved in 75 parts by weight of toluene by means of a ball mill to prepare a coating fluid for the photosensitive layer 102. The coating fluid thus obtained was applied on the surface of the aluminum substrate, by wire bar coating in a coating weight providing a layer thickness of 18 $\mu$m after drying, to form a wet coating, which was then dried to form the photosensitive layer 102 with a thickness of 18 $\mu$m.

The electrophotographic photosensitive members (Sample Nos. 57 to 65) thus obtained were evaluated in the same manner as in Example 1.

Results obtained are shown in Table 4.

[Comparative Example 10]

An electrophotographic photosensitive member (Sample No. E-10) was produced in the same manner as in Example 57 except that the polysilane compound No. 30 was replaced with the following polysilane compound (D-6) (f is an integer; Mw: 50,000).

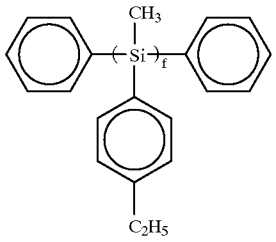

The electrophotographic photosensitive member thus obtained was evaluated in the same manner as in Example 57.

Results obtained are shown in Table 4.

TABLE 4

| | Sample No. | Polysilane compound No. | E½ (Lux/sec.) | $V^o_{SL}$ | $\Delta V_{SL}$ | Initial image | Images after running | State of coating film |
|---|---|---|---|---|---|---|---|---|
| Example: | | | | | | | | |
| 1 | 1 | 8 | 0.7 | 0 | −5 | Good | Good | Good |
| 2 | 2 | 1 | 1.0 | 0 | +5 | Good | Good | Good |
| 3 | 3 | 2 | 1.2 | 0 | −5 | Good | Good | Good |
| 4 | 4 | 3 | 1.3 | 0 | −5 | Good | Good | Good |
| 5 | 5 | 4 | 1.1 | 0 | −5 | Good | Good | Good |
| 6 | 6 | 5 | 1.2 | 0 | −7 | Good | Good | Good |
| 7 | 7 | 6 | 1.1 | 0 | +5 | Good | Good | Good |
| 8 | 8 | 7 | 1.2 | 0 | −7 | Good | Good | Good |
| 9 | 9 | 9 | 0.8 | 0 | −6 | Good | Good | Good |
| 10 | 10 | 10 | 0.7 | 0 | −4 | Good | Good | Good |
| 11 | 11 | 11 | 0.8 | 0 | −5 | Good | Good | Good |
| 12 | 12 | 12 | 0.7 | 0 | −4 | Good | Good | Good |
| 13 | 13 | 13 | 0.9 | 0 | −6 | Good | Good | Good |
| 14 | 14 | 14 | 0.9 | 0 | +7 | Good | Good | Good |
| 15 | 15 | 15 | 0.9 | 0 | −5 | Good | Good | Good |
| 16 | 16 | 16 | 1.2 | 0 | −5 | Good | Good | Good |
| 17 | 17 | 17 | 1.1 | 0 | −6 | Good | Good | Good |
| 18 | 18 | 18 | 0.8 | 0 | +7 | Good | Good | Good |

TABLE 4-continued

| | | | | | | | | |
|---|---|---|---|---|---|---|---|---|
| 19 | 19 | 19 | 0.7 | 0 | −4 | Good | Good | Good |
| 20 | 20 | 20 | 0.7 | 0 | −6 | Good | Good | Good |
| 21 | 21 | 21 | 0.8 | 0 | −5 | Good | Good | Good |
| 22 | 22 | 22 | 0.8 | 0 | −5 | Good | Good | Good |
| 23 | 23 | 23 | 0.9 | 0 | −5 | Good | Good | Good |
| 24 | 24 | 24 | 0.7 | 0 | −5 | Good | Good | Good |
| 25 | 25 | 25 | 0.7 | 0 | −2 | Good | Good | Good |
| 26 | 26 | 26 | 0.8 | 0 | +4 | Good | Good | Good |
| 27 | 27 | 27 | 0.9 | 0 | −6 | Good | Good | Good |
| 28 | 28 | 28 | 1.0 | −3 | −4 | Good | Good | Good |
| 29 | 29 | 29 | 1.1 | −2 | −5 | Good | Good | Good |
| 30 | 30 | 30 | 0.8 | 0 | −5 | Good | Good | Good |
| 31 | 31 | 31 | 0.9 | 0 | −5 | Good | Good | Good |
| 32 | 32 | 32 | 0.9 | 0 | +5 | Good | Good | Good |
| 33 | 33 | 33 | 1.0 | −3 | −6 | Good | Good | Good |
| 34 | 34 | 34 | 0.8 | 0 | −5 | Good | Good | Good |
| 35 | 35 | 35 | 0.7 | 0 | −7 | Good | Good | Good |
| 36 | 36 | 36 | 0.7 | 0 | −6 | Good | Good | Good |
| 37 | 37 | 37 | 0.8 | 0 | −4 | Good | Good | Good |
| 38 | 38 | 38 | 0.8 | 0 | −5 | Good | Good | Good |
| 39 | 39 | 39 | 0.9 | 0 | −4 | Good | Good | Good |
| 40 | 40 | 40 | 0.7 | 0 | −5 | Good | Good | Good |
| 41 | 41 | 41 | 0.7 | 0 | +5 | Good | Good | Good |
| 42 | 42 | 42 | 0.8 | 0 | +4 | Good | Good | Good |
| 43 | 43 | 43 | 0.9 | 0 | +5 | Good | Good | Good |
| 44 | 44 | 44 | 0.8 | 0 | +4 | Good | Good | Good |
| 45 | 45 | 45 | 0.8 | 0 | −5 | Good | Good | Good |
| 46 | 46 | 46 | 0.8 | 0 | +3 | Good | Good | Good |
| 47 | 47 | 47 | 0.7 | 0 | −4 | Good | Good | Good |
| 48 | 48 | 48 | 0.7 | 0 | −5 | Good | Good | Good |
| 49 | 49 | 49 | 0.7 | 0 | +4 | Good | Good | Good |
| 50 | 50 | 50 | 0.7 | 0 | −4 | Good | Good | Good |
| 51 | 51 | 51 | 0.8 | 0 | −3 | Good | Good | Good |
| 52 | 52 | 52 | 0.9 | 0 | −4 | Good | Good | Good |
| 53 | 53 | 35 | 1.1 | +2 | −5 | Good | Good | Good |
| 54 | 54 | 36 | 1.2 | 0 | −2 | Good | Good | Good |
| 55 | 55 | 46 | 1.1 | +2 | +3 | Good | Good | Good |
| 56 | 56 | 52 | 1.2 | +2 | −5 | Good | Good | Good |
| 57 | 57 | 30 | 1.5 | 0 | −2 | Good | Good | Good |
| 58 | 58 | 48 | 1.5 | 0 | −2 | Good | Good | Good |
| 59 | 59 | 49 | 1.5 | 0 | −1 | Good | Good | Good |
| 60 | 60 | 53 | 1.4 | 0 | −2 | Good | Good | Good |
| 61 | 61 | 54 | 0.8 | 0 | −5 | Good | Good | Good |
| 62 | 62 | 55 | 0.9 | 0 | −4 | Good | Good | Good |
| 63 | 63 | 56 | 0.8 | 0 | −2 | Good | Good | Good |
| 64 | 64 | 57 | 1.0 | 0 | −5 | Good | Good | Good |
| 65 | 65 | 58 | 0.8 | 0 | −4 | Good | Good | Good |

| | Sample No. | Polysilane compound No. | E½ (Lux/sec.) | $V^{o}_{SL}$ | $\Delta V_{SL}$ | Initial image | Images after running | State of coating film |
|---|---|---|---|---|---|---|---|---|
| Comparative Example: | | | | | | | | |
| 1 | E-1 | D-1 | 1.8 | −35 | Unmeasurable due to peeling | Black lines | Layer 203 peeled | Cracked |
| 2 | E-2 | D-2 | 1.9 | −30 | +50 | Fogged in black spots | Whole area fogged | Orange peel surface |
| 3 | E-3 | D-3 | 1.7 | −25 | +40 | Black spots due to pinholes | Large black spots | Cissing |
| 4 | E-4 | D-4 | 1.9 | −40 | Unmeasurable due to peeling | Black lines | Layer 203 peeled | Cracked Cracked |
| 5 | E-5 | D-1 | 2.5 | +30 | Unmeasurable due to peeling | Black lines | Layer 303 peeled | Cracked |
| 6 | E-6 | D-2 | 2.0 | +35 | Unmeasurable due to peeling | Uneven image density | Layer 303 peeled | Layer 303 surged |
| 7 | E-7 | D-3 | 2.2 | −28 | Unmeasurable due to peeling | Black spots due to pinholes | Layer 303 disappeared | Cissing |

TABLE 4-continued

| | | | | | | | | |
|---|---|---|---|---|---|---|---|---|
| 8 | E-8 | D-4 | 2.5 | +35 | Unmeasurable due to peeling | Black lines | Layer 303 peeled | Cracked |
| 9 | E-9 | D-5 | 10.0 | +50 | Unmeasurable due to peeling | Blank images | All layers peeled | Lifted from support 301 |
| 10 | E-10 | D-6 | 2.1 | −10 | +10 | Good | Conspicuous ghost | Good |

What is claimed is:

1. An electrophotographic photosensitive member comprising a support, a photosensitive layer provided on the support; the photosensitive layer containing a polysilane compound which has a structural unit represented by the following Formula (1) and has as a terminal group of the polymer chain a group selected from the group consisting of hydroxy, alkoxy and aryloxy (1)

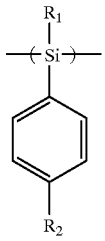

wherein $R_1$ represents a hydrogen atom, an alkyl group or an aralkyl group; $R_2$ represents an ethyl group, a cycloalkyl group, a vinyl group, or an alkyl group or unsaturated hydrocarbon group having 3 or more carbon atoms, whose carbon atom directly bonded to the phenyl group is a primary carbon atom or a secondary carbon atom.

2. An electrophotographic photosensitive member according to claim 1, wherein a polysilane compound represents by the following Formula (2)

(2)

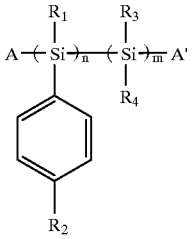

wherein $R_1$ represents a hydrogen atom, an alkyl group or an aralkyl group; $R_2$ represents an ethyl group, a cycloalkyl group, a vinyl group, or an alkyl group or unsaturated hydrocarbon group having 3 or more carbon atoms, whose carbon atom-directly bonded to the phenyl group is a primary carbon atom or a secondary carbon atom; $R_3$ and $R_4$ each represent an alkyl group, an aryl group, an aralkyl group or an alkoxyl group; n and m represent the proportion of monomer units, where n is not 0 and the sum of n and m is 1; A and A' each represent a hydroxyl group, an alkoxyl group or an aryloxyl group.

3. An electrophotographic photosensitive member according to claim 1, wherein $R_1$ is an alkyl group and $R_2$ is an ethyl group.

4. An electrophotographic photosensitive member according to claim 1, wherein said photosensitive layer has a charge generation layer and a charge transport layer, and the charge transport layer contains the polysilane compound represented by Formula (1).

5. A process cartridge comprising an electrophotographic photosensitive member and at least one means selected from the group consisting of a charging means, a developing means and a cleaning means; said electrophotographic photosensitive member and said at least one means are supported as one unit and being detachably mountable to the main body of an electrophotographic apparatus;

said electrophotographic photosensitive member comprising a support, a photosensitive layer provided on the support; said photosensitive layer containing a polysilane compound which has a structural unit represented by the following Formula (1) and has as a terminal group of the polymer chain a group selected from the group consisting of hydroxy and aryloxy (1)

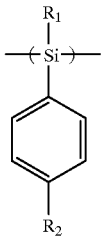

wherein $R_1$ represents a hydrogen atom, an alkyl group or an aralkyl group; $R_2$ represents an ethyl group, a cycloalkyl group, a vinyl group, or an alkyl group or unsaturated hydrocarbon group having 3 or more carbon atoms, whose carbon atom directly bonded to the phenyl group is a primary carbon atom or a secondary carbon atom.

6. A process cartridge according to claim 5, wheren a polysilane compound represents by the following Formula (2)

(2)

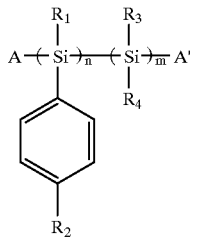

wherein $R_1$ represents a hydrogen atom, an alkyl group or an aralkyl group; $R_2$ represents an ethyl group, a cycloalkyl group, a vinyl group, or an alkyl group or unsaturated hydrocarbon group having 3 or more carbon atoms, whose carbon atom directly bonded to the phenyl group is a primary carbon atom or a secondary carbon atom; $R_3$ and $R_4$ each represent an alkyl group, an aryl group, an aralkyl group or an alkoxyl group; n and m represent the proportion of monomer units, where n is not 0 and the sum of n and m is 1; A and A' each represent a hydroxyl group, an alkoxyl group or an aryloxyl group.

7. A process cartridge according to claim 5, wherein $R_1$ is an alkyl group and $R_2$ is an ethyl group.

8. A process cartridge according to claim 5, wherein said photosensitive layer has a charge generation layer and a charge transport layer, and the charge transport layer contains the polysilane compound represented by Formula (1).

9. An electrophotographic apparatus comprising an electrophotographic photosensitive member, a charging means, an exposure means, a developing means and a transfer means;

said electrophotographic photosensitive member comprising a support, a photosensitive layer provided on the support; said photosensitive layer containing a polysilane compound which has a structural unit represented by the following Formula (1) and has as a terminal group of the polymer chain a group selected from the group consisting of hydroxy, alkoxy and aryloxy (1)

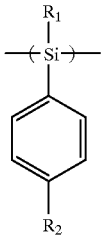

wherein $R_1$ represents a hydrogen atom, an alkyl group or an aralkyl group; $R_2$ represents an ethyl group, a cycloalkyl group, a vinyl group, or an alkyl group or unsaturated hydrocarbon group having 3 or more carbon atoms, whose carbon atom directly bonded to the phenyl group is a primary carbon atom or a secondary carbon atom.

10. An electrophotographic apparatus according to claim 9, wherein a polysilane compound represents by the following Formula (2)

(2)

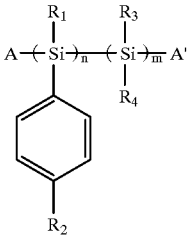

wherein $R_1$ represents a hydrogen atom, an alkyl group or an aralkyl group; $R_2$ represents an ethyl group, a cycloalkyl group, a vinyl group, or an alkyl group or unsaturated hydrocarbon group having 3 or more carbon atoms, whose carbon atom directly bonded to the phenyl group is a primary carbon atom or a secondary carbon atom; $R_3$ and $R_4$ each represent an alkyl group, an aryl group, an aralkyl group or an alkoxyl group; n and m represent the proportion of monomer units, where n is not 0 and the sum of n and m is 1; A and A' each represent a hydroxyl group, an alkoxyl group or an aryloxyl group.

11. An electrophotographic apparatus according to claim 9, wherein $R_1$ is an alkyl group and $R_2$ is an ethyl group.

12. An electrophotographic apparatus according to claim 9, wherein said photosensitive layer has a charge generation layer and a charge transport layer, and the charge transport layer contains the polysilane compound represented by Formula (1).

* * * * *